US011435697B2

(12) United States Patent
Droz-dit-Busset et al.

(10) Patent No.: US 11,435,697 B2
(45) Date of Patent: Sep. 6, 2022

(54) TIMEPIECE WITH A MECHANICAL OSCILLATOR

(71) Applicant: CSEM Centre Suisse d'Electronique et de Microtechnique SA—Recherche et Développement, Neuchâtel (CH)

(72) Inventors: Fabien Droz-dit-Busset, Thielle (CH); Florent Cosandier, Colombier (CH)

(73) Assignee: CSEM CENTRE SUISSE D'ELECTRONIQUE ET DE MICROTECHNIQUE SA—RECHERCHE ET DÉVELOPPEMENT, Neuchaâtel (CH)

( * ) Notice: Subject to any disclaimer, the term of this patent is extended or adjusted under 35 U.S.C. 154(b) by 612 days.

(21) Appl. No.: 16/363,287

(22) Filed: Mar. 25, 2019

(65) Prior Publication Data

US 2019/0324399 A1 Oct. 24, 2019

(51) Int. Cl.

| | |
|---|---|
| ***G04B 15/00*** | (2006.01) |
| ***G04B 17/06*** | (2006.01) |
| ***G04B 15/08*** | (2006.01) |

(52) U.S. Cl.

CPC ..... *G04B 17/063* (2013.01); *G04B 15/08* (2013.01)

(58) Field of Classification Search

CPC ..... G04B 17/063; G04B 15/08; G04B 13/02; G04B 17/06

See application file for complete search history.

(56) References Cited

U.S. PATENT DOCUMENTS 9,958,833 B2 * 5/2018 Sarchi ..... G04B 17/04

FOREIGN PATENT DOCUMENTS

| | | | |
|---|---|---|---|
| WO | 0118611 A1 | 3/2001 | |
| WO | 0159529 A1 | 8/2001 | |
| WO | WO-0159529 A1 * | 8/2001 | ..... G04B 17/285 |
| WO | 2004097533 A2 | 11/2004 | |

OTHER PUBLICATIONS

Search Report issued in Swiss Patent Application No. 00407/18, dated Sep. 30, 2019.

(Continued)

*Primary Examiner* — Sean Kayes

(74) *Attorney, Agent, or Firm* — Pearne & Gordon LLP

(57) ABSTRACT

A sprung balance type mechanical timekeeper, includes a spiral spring (10), a balance (20) and an escapement mechanism (30) connected by a point of attachment (12) to the spiral spring and arranged to sustain an oscillation of the balance. The escapement mechanism (30) is connected to the point of attachment (12) of the spiral spring by a chassis (40) pivoted about the axis (A) of the balance. An outer end (12) of the spiral spring (10) is attached to this transverse pert (40) at a location located on one side of the balance axis (A). The chassis (40) includes two branches extending on either side of the axis of the balance (20) and forming a rotary plate whose axis of rotation is coincident with the axis of oscillation of the balance (20). The escapement mechanism (30) is located on the other side of the balance axis (A) and acts on the pivoted chassis (40) so as to free its rotation and thus make the attached end (12) of the spiral spring rotate.

12 Claims, 3 Drawing Sheets

(56) References Cited

OTHER PUBLICATIONS

Search Report issued in European Patent Application No. 19165050 dated Aug. 30, 2019.
Written Opinion issued in European Patent Application No. 19165050 dated Aug. 30, 2019.
Reinhard, Meis, "Das Tourbillion", Dec. 31, 1993, p. 34-35 and 90-91.
Reinhard, Meis, "Das Tourbillion", Dec. 31, 1993, p. 255.
Jiaxian, Su, "Introducing The Wilhelm Rieber Flying Tourbillion Wristwatch With Spring Detent Escapement", Dec. 7, 2014, http://watchesbysjx.com/2014/12/introducing-the-wilhelm-rieber-flying-tourbillon-wristwatch-with-spring-detent-escagement.html, retrieved on: May 9, 2018.

* cited by examiner

TIMEPIECE WITH A MECHANICAL OSCILLATOR

This invention concerns a sprung-balance type timekeeper with a spiral spring and a balance. The invention is particularly adapted to wristwatches but may also apply to other time measuring mechanisms such as table pendulums, wall pendulums and other instruments filling the function of a timekeeper.

CH 709 277/EP 3 347 725 describe a rotary detent escapement, for sustaining the oscillation of a solid-state oscillator (elastic inertia). The detent is also a solid-state type one. The impulse is imparted by a direct torque. It is the axis of the balance which directly receives the motor torque. The detent allows releasing this motor torque. It consists of an oscillator on a flexible pivot whose low operating amplitude allows suppressing the risk of a gallop (teeth skips of the detent, at the level of the escape wheel) and therefore solving the main drawback of detent escapements in a watch.

CH 709 279 describes a regulator device which imposes a periodic motion at least of the resting point of the resonator with a regulation frequency comprised between n*0.9w and n*1.1w0, with n an integer > or =2 and w0 the natural frequency of the main resonator. However, it would be desirable to impose to the stud a periodic rotational motion about the axis of the balance, with a periodic motion whose frequency is well below the natural frequency of the sprung-balance resonator.

EP 1097 408 B1 describes a sprung-balance type time indicator with constant torque, with a spiral spring and a balance. An oscillation of the balance is sustained through an escape mobile by displacement of a point of attachment of the spiral spring at the time of the passage at the impulse point of the oscillator, resulting in a circular motion of the point of attachment of the spiral spring around the axis of the oscillator and causing a rotation of the balance-spiral-escapement set. In this known device, one end of the spiral spring, the inner end, is fastened by a fastening stud to the escape mobile. The other end of the spiral spring, the outer end, is fastened to the balance. The fastening stud of the spiral spring being secured to the escape mobile, it transmits to the spiral spring the angular motion imparted thereon, storing a potential energy in the spiral spring which will initiate the oscillation of the balance.

This invention aims at providing a sprung-balance type mechanical timekeeper, including a spiral spring, a balance and an escapement mechanism connected by a point of attachment to the spiral spring and arranged to sustain an oscillation of the balance, which has a minimum disturbance on its reference oscillator and where the frequency of the oscillator is more stable and the time measurement is more accurate.

Thus, an object of the invention is a sprung-balance type mechanical timekeeper of the aforementioned type, wherein the escapement mechanism is connected to the point of attachment of the spiral spring by a part, hereinafter called chassis, the chassis being pivoted about the axis of the balance; an outer end of the spiral spring is attached to this chassis and the escapement mechanism is also secured to the chassis and acts on the pivoted chassis so as to make it rotate and thus make the attached end of the spiral spring rotate.

The balance is mounted on, and coaxial with, a fixed ring gear, and the chassis carries a planet wheel which is engaged with said ring gear and which is driven in a stepped manner by the escape mobile.

Typically, the chassis includes two branches extending on either side of a disk coaxial with the balance and forming a rotary plate whose axis of rotation is coincident (coaxial) with the axis of oscillation of the balance.

Advantageously, the escapement mechanism includes an escape lever pivoting between a rest position engaged with the escape wheel and a position disengaged from the escape wheel. In one embodiment, this escape lever includes a short inner arm provided with an engagement tooth which is engaged with the escape wheel, and a long outer arm located in the path of an impulse element secured to the balance, which impulse element is brought, during the oscillation of the balance, to displace the escape lever from its rest position towards its disengaged position.

In one embodiment, the escape lever is pivotally mounted at the outer end of an arm which extends, secured to and coplanar with the chassis, outwardly from the axis of the planet wheel and of the escape wheel and beyond or within the periphery of the balance.

Usually, the outer end of the spiral spring is attached to one end of the chassis by a stud which extends vertically between the plane of the transverse part and the plane of the spiral spring, the plane of the spiral spring being disposed between the plane of the transverse part, or chassis, and the balance.

The invention also concerns a timepiece, such as a wristwatch, a table pendulum or a wall pendulum, including a timekeeper as previously described.

The invention allows reducing simultaneously the influence of several sources of disturbances originating from the counting of the number of oscillations of the balance (by reduction of the number of interactions for each cycle), from the sustainment of its amplitude as well as the influence of the orientation of the oscillator in the gravitational field. The invention combines the advantages of a detent escapemrnt with the displacement of the point of attachment of the spring of the reference oscillator and the use of a planetary gear serving as a tourbillon.

The invention takes advantage of the principle of the detent escapement. The detent escapement is known for having a reduced influence on the regular operation of the timekeeper in comparison with other conventional escapements. The invention introduces a variant of the detent escapement which allows reducing further its influence by eliminating or to the least by reducing the need for the impulse impact used for the sustainment of the oscillation amplitude.

All or part of the sustainment of the oscillation amplitude of the oscillator is obtained by the displacement of the fastening point of its return member (the stud of the spiral in the case of a conventional balance).

The present invention is a particular application of the family of timekeepers with tourbillons used in other forms as of the XVIII$^{th}$ century. The oscillator as well as the escapement performs a full rotation in a few tens of seconds in the same plane as the oscillator.

Thanks to the present invention, the oscillator is barely disturbed. Indeed, the transfer to the escapement mechanism of a portion of the energy of the oscillation system necessary to clear the teeth of the escape wheel influences the operation of the oscillator only once for each cycle, which allows having a lesser disturbance of the operation of the oscillator. The influence of the counting of the number of oscillations on a conventional mechanism with an anchor escapement induces two disturbances for each cycle of the oscillator.

Moreover, the displacement of the stud, instead of or complementarily with the impulse imparted by conventional escapement mechanisms, ensures sustainment of the oscillation amplitude without, or to the least while reducing, the impact disturbing the operation of the oscillator.

A drawback of the detent escapement is the risk of a clearance for a too long period of the detent which may then cause the release of several teeth of the escape wheel (gallop). The mechanism as described in the present invention avoids this problem because the escape wheel is slowed down by the inertia of the chassis and thus the detent has time to regain its position on time and avoid the occurrence of a gallop.

Another advantage of the present invention is that the oscillator and the escapement mechanism complete a full turn in a few tens of seconds around themselves in the plane of the oscillator thanks to the planetary device, and thus average out the negative effects of the rotating unbalance of the balance when the oscillation plane of the balance is not perpendicular to the gravitational field.

The energy transmitted to the oscillator by the displacement of the point of attachment of the spiral is constant and depends on the distance of the displacement of the stud which is constant. The energy transmitted to the oscillator for the sustainment of its amplitude by this displacement no longer depends on the force of the barrel as soon as this force becomes sufficient to ensure the displacement of the stud.

Moreover, with a specific selection of the ratio of the gear train of the planetary gear, it is possible to ensure a constant amplitude of the oscillation and thus, optimize its properties by the selection of the oscillation amplitude (for example 220°).

The features of the invention will come out more clearly on reading the description of several embodiments provided only as a non-limiting example with reference to the following figures in which.

Figure 1:
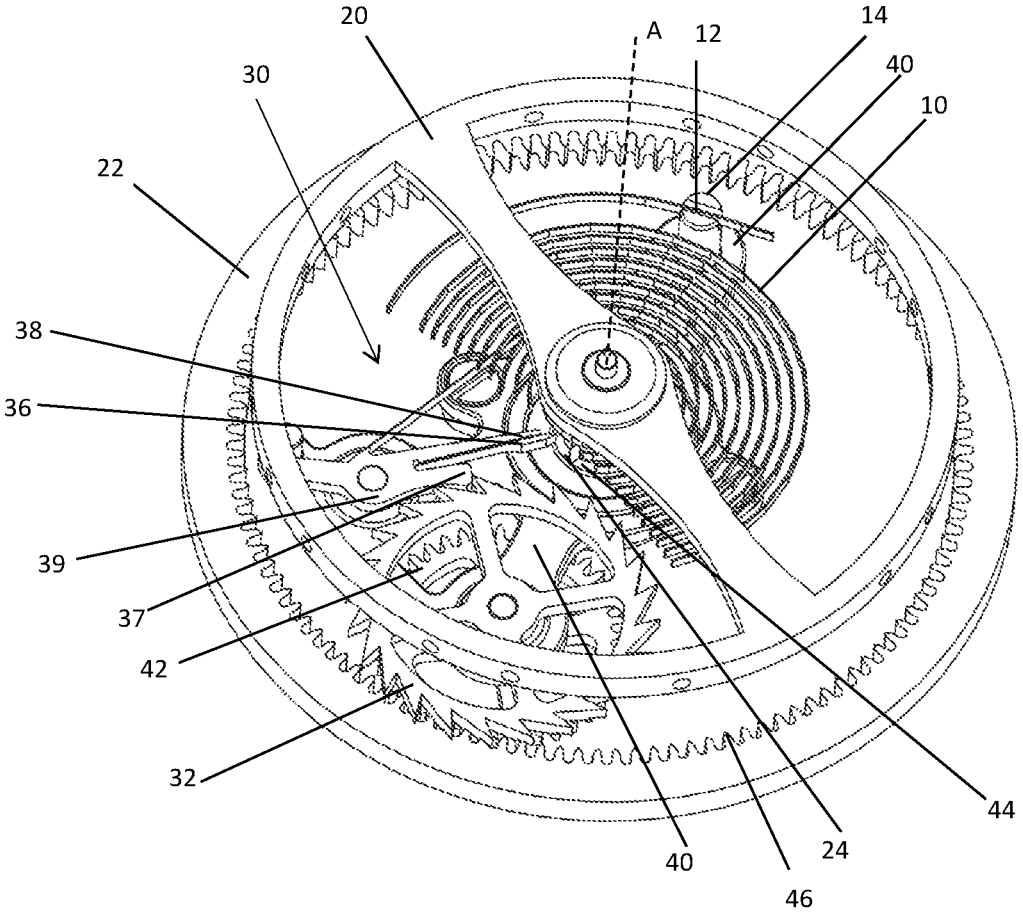
FIG. 1 represents a partial perspective view of a timekeeper according to the present invention with the spiral spring partially cut.

FIG. 1 illustrates, as example, a sprung-balance type mechanical timekeeper according to the invention, including a spiral spring 10, a balance 20 and a detent escapement mechanism 30 connected by a point of attachment to the spiral spring and arranged to sustain an oscillation of the balance.

As illustrated, the detent escapement mechanism 30 is connected to the point of attachment 12 of the spiral spring 10 by a chassis 40 which pivots about the axis A of the balance. An outer end 12 of the spiral spring 10 is attached to this chassis 40 at a location located on one side of the balance axis A, the inner end of the spiral spring 10 being fastened by the center of the balance 20. The detent escapement mechanism 30 is located on the other side of the balance axis A and acts on the pivoting chassis 40 to make it rotate about the axis A and thus make the attached end 12 of the spiral spring 10 rotate about the axis A.

The balance 20 is mounted on, and coaxial with, a fixed ring gear 22 including an inner toothing 46, and the chassis 40 carries, on said other side of the balance axis A, a planet pinion 42 which is engaged with said ring gear 22 and which is driven in a stepped manner by the detent escapement mechanism 30.

The chassis 40 includes several branches extending on either side of the axis of rotation of the balance 20 at an angle of about 120°. The chassis 40 forms a rotary plate whose axis of rotation is coincident with the axis of rotation A of the balance 20.

The timekeeper according to the invention includes an escape wheel 32 coaxial with and secured to the planet pinion 42.

The detent escapement mechanism 30 includes an escape body 39 pivoting between a test position engaged with the escape wheel 32 and a position cleared off the escape wheel 32. This pivoted escape body 39 includes a short inner arm provided with a rest plane 37 which is engaged with the escape wheel 32, and a stop 38 located in the path of an impulse pin 24 secured in oscillation with the balance 20, which impulse pin 24 is brought, during the oscillation of the balance 20, to displace the escape lever 36/37/38/39 from its rest position towards its cleared position.

The escape body 39 is pivotally mounted at one of the outer ends of the chassis 40.

As illustrated, the outer end 12 of the spiral spring 10 is attached to an end of the chassis 40 by a stud 14 which extends vertically between the plane of the chassis 40 and the plane of the spiral spring 10.

FIG. 1 illustrates the timekeeper in its position when the impulse pin 24 in advance (oscillation of the balance 20 in a counterclockwise direction in the drawing) leaves the escape body 39 in its rest position with the rest plane 37 engaged against the escape wheel 32 in order to block the latter and the planet pinion 42. Afterwards, the balance 20 continues its oscillation in this direction, and then reverses its direction of oscillation. When the impulse pin 24, oscillating in the clockwise direction, hits the end of the stop of the flexible blade 38, the escape body 39 is displaced and releases the tooth 37 from its engagement with the escape wheel 32 which is therefore free to rotate and the planet pinion 42 rotates with the escape wheel 32 and displaces the chassis 40. During a new change in the direction of oscillation, the impulse pin 24, passing opposite the detent, bends the detent flexible blade 36 and passes the end of the stop of the detent flexible blade 38 without clearing the escape wheel 32, arriving at the illustrated start position, and so on.

The described concept is based on a conventional sprung-balance oscillator. The entire mechanism rests on the chassis 40 whose axis of rotation is coincident with the axis of rotation of the balance 20. The planet pinion 42 meshes with the planet ring 22. The detent escapement 30, the escape wheel 32, the planet wheel 42, the support of the stud 14 of the spiral spring 10 are all adjacent to the planet chassis. The planet pinion 42 and the escape wheel 32 are secured to each other.

Figure 2:
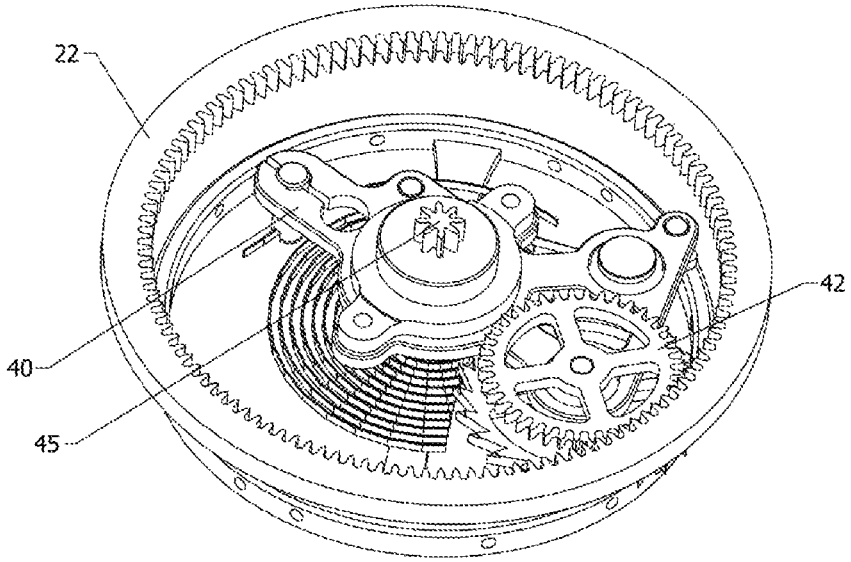
FIG. 2 represents a rear view of FIG. 1.

The planet ring 22 is fixed (does not oscillate, does not rotate). A rotational torque is exerted on the chassis pinion 45 (FIG. 2). This torque tends to make the planet pinion 42, and thus the chassis, rotate. The planet pinion 42 is retained in its rotation by blockage of the escape wheel 32 by the detent mechanism 30. The rotation of the escape wheel 32 is possible only once for each oscillation cycle of the balance 20, when it releases the detent mechanism 30. Thus, once every oscillation cycle of the balance 20, the planet-carrier plate can perform one rotation whose amplitude depends on the ratio of the numbers of teeth of the different wheels. This rotation will cause a displacement of the stud 14 so as to ensure or contribute in sustaining the oscillation amplitude of the balance 29. Hence, the detent mechanism does not necessarily act on the balance 20 to sustain the oscillation amplitude thereof by a direct action as in the case of a conventional detent escapement. Alternatively, the arm comprising the rest plane 37, pushed by the escape wheel 32, may be extended so that the detent mechanism also acts on the impulse pin. In this variant, the energy transmitted to the balance to sustain its amplitude is then distributed between the displacement of the stud and the impulse of the extended arm of the detent. In both variants, the chassis pinion 45 (FIG. 2) also performs a rotation which ensures counting of the number of oscillations cycles performed by the balance 20.

The rotational angle of the planet-carrier plate may be calculated so as to ensure an optimum amplitude of the rotational angle of the balance 20 in steady running.

A wheel train connects a barrel (not illustrated) which ensures coupling on the planet pinion 42 by the chassis pinion 45; and through the ratio of the teeth of the wheels, it is possible to obtain an adequate rotational speed for each of them in order to display for example, the hour, the minute and the second or other time measurements.

Figure 3:
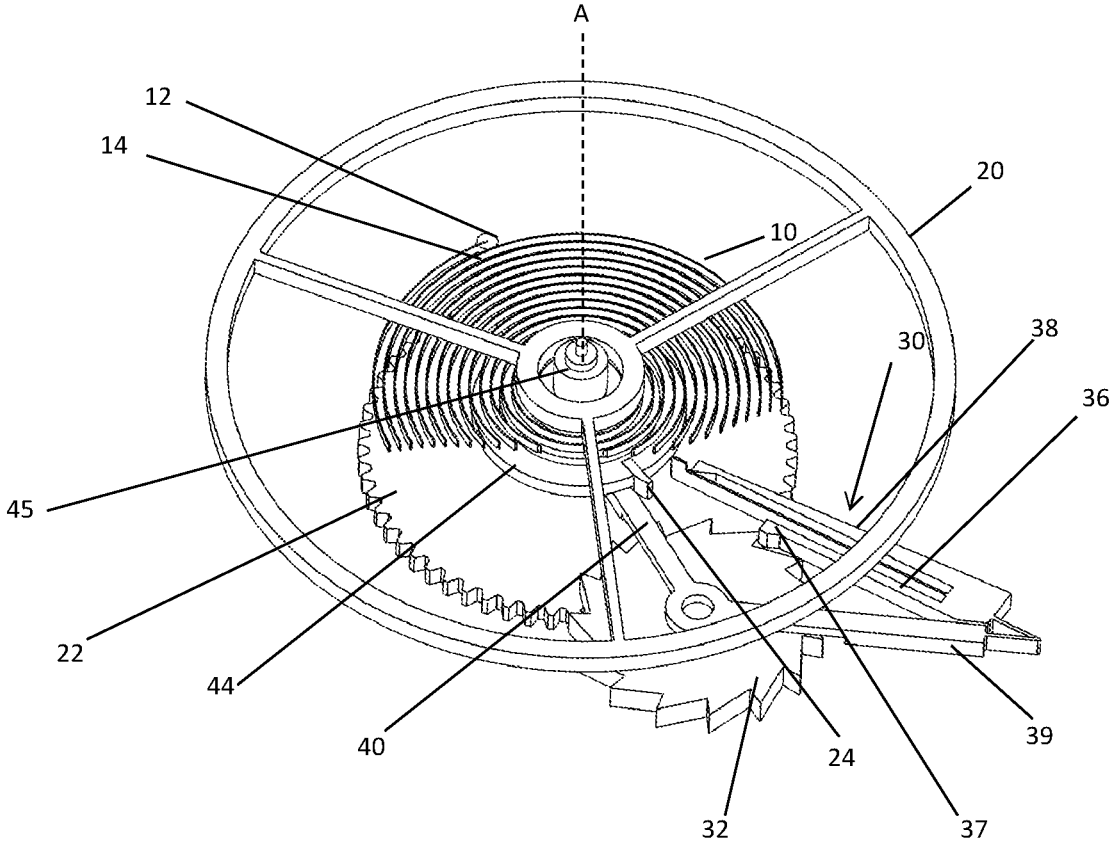
FIG. 3 represents a perspective view of another timekeeper according to the invention.

FIG. 3 illustrates another embodiment of a sprung-balance type mechanical timekeeper according to the invention, including a spiral spring 10, a balance 20 and a detent escapement mechanism 30 connected by a point of attachment to the spiral spring and arranged to sustain an oscillation of the balance.

As illustrated in FIG. 3, the detent escapement mechanism 30 is connected to the point of attachment 12 of the spiral spring 10 by a transverse part 40 which pivots about the axis A of the balance. An outer end 12 of the spiral spring 10 is attached to this transverse part 40 at a location located on one side of the balance axis A, the inner end of the spiral spring 10 being fastened by the center of the balance 20. The detent escapement mechanism 30 is located on the other side of the balance axis A and acts on the pivoting transverse part 40 so as to make it rotate about the axis A and thus make the attached end 12 of the spiral spring 10 rotate about the axis A.

The balance 20 is mounted on, and coaxial with, a fixed ring gear 22 including an outer toothing, and the transverse part 40 carries, on said other side of the balance axis A, a planet pinion 42 which is engaged with said ring gear 22 and which is driven in a stepped manner by the detent escapement mechanism 30.

The transverse part 40 includes two branches extending on either side of a disk 44 coaxial with the balance 20. This disk 44 forms with the transverse part 40 a chassis or a rotary plate whose axis of rotation is coincident with the axis of rotation of the balance 20.

The timekeeper according to the invention includes an escape wheel 32 coaxial with and secured to the planet wheel 42. Alternatively, the detent escape mobile may be replaced with another escapement device.

Figure 4:
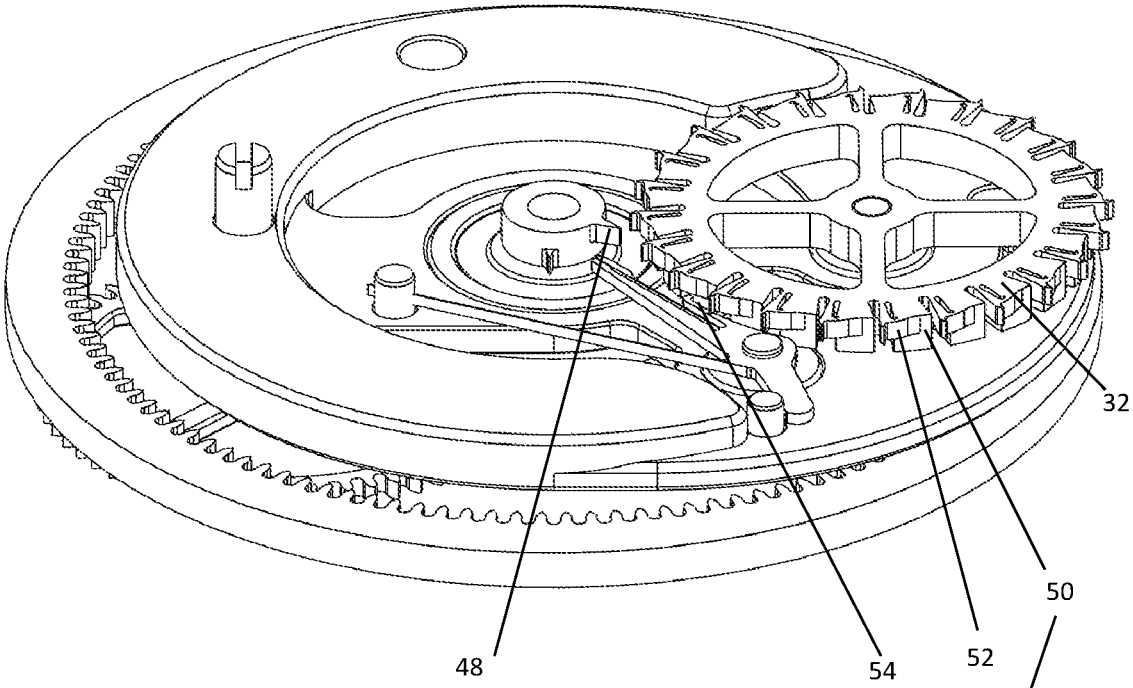
FIGS. 4 and 5 respectively represent a perspective view and a top view of a timekeeper according to the invention wherein the teeth of the escape wheel include an inclined plane and a clearance plane.
Figure 5:
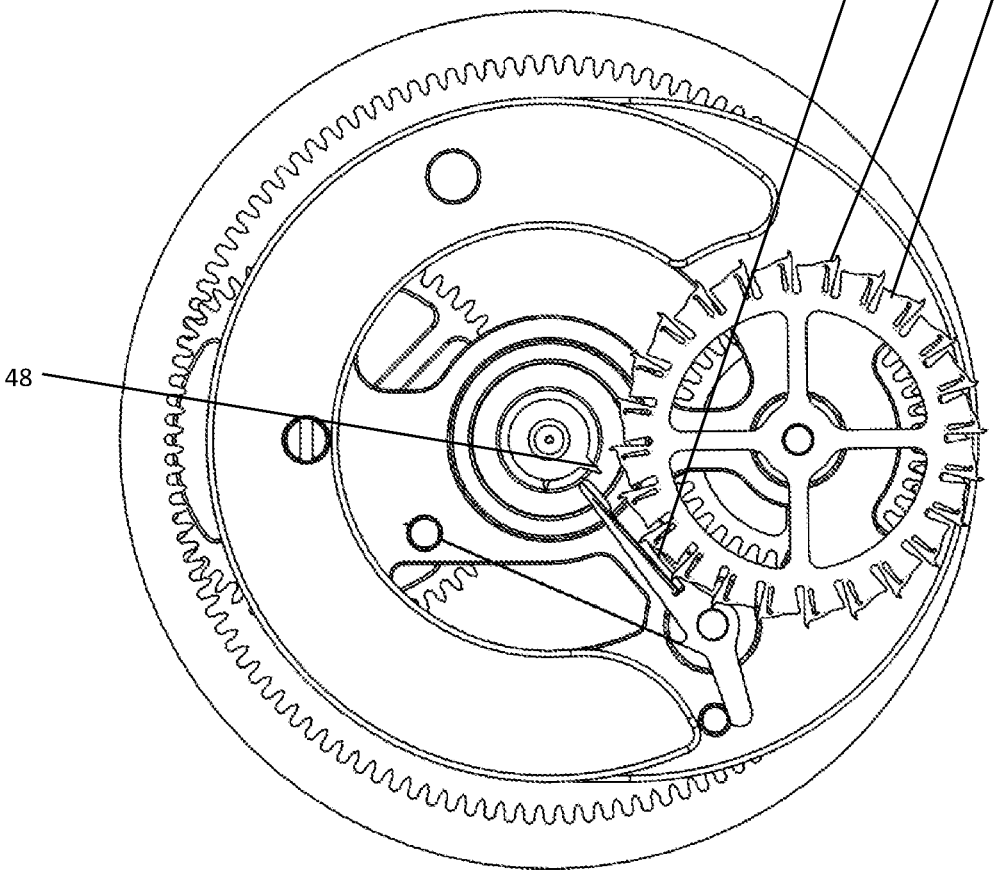

In the embodiment illustrated in FIGS. 4 and 5, the timekeeper includes two impulse types. A first impulse type occurs when the oscillation amplitude of the balance is low. It consists of a direct impulse of a tooth of the escape wheel 52 which acts on an additional pin 48. The inertia of the escape wheel mobile added to the inertia of the chassis mobile as well as the motor torque are selected such that this impulse type occurs only when the passage speed of the balance is relatively low, that is to say when the amplitude of said balance is low. Once a threshold of the oscillation amplitude of the balance is exceeded, the escape wheel can no longer catch the balance during its acceleration phase and no longer comes into contact with the additional pin 48. Thus, there is no longer any impact disturbing the oscillation frequency of the balance.

In a second phase, where the direct impulses no longer take place, only the impulses by displacement of the point of attachment of the stud to the chassis take place. This impulse type occurs regardless of the amplitude of the oscillations of the balance. Potentially, this impulse type disturbs the oscillation frequency of the balance considerably lesser than the direct impact.

In addition, the escape wheel has a clearance plane 50 on its teeth interacting with the short arm of the detent. This clearance plane prevents a too rapid return of the detent after the release thereof. Indeed, during the passage of the balance in the direction of clearance of the detent, the balance makes the detent pivot through its pin, the beak of the tooth of the escape wheel leaves the rest plane of the detent, it arrives on the inclined plane 54 of the detent and makes the latter pivot so as to let the balance pass. However, since the latter has an inertia which is much lighter than the balance, it tends to return back to its initial position too quickly with the risk of interacting again with the pin of the balance. Thus, there is a risk of multiple contacts between the long arm of the detent and the pin of the balance which is not desirable.

Thus, in order to prevent multiple contacts, the escape wheel is provided with a clearance plane 50, provided in order that the detent remains held in its passing position, the time the balance is cleared. The clearance of the balance is guaranteed by the interaction between a tooth of the escape wheel 52 and the additional pin 48 where the angle that it forms with the balance pin has been established for this purpose.

LEGEND

10 spiral spring
12 point of attachment/outer end of the spiral spring
14 Stud
20 Balance
22 fixed ring gear
24 impulse pin
30 escapement mechanism
32 escape wheel
36 detent flexible blade
37 rest plane of the detent
38 stop of the detent flexible blade
39 detent body
40 transverse part called chassis
42 planet pinion
44 Disk
45 chassis pinion
46 inner toothing
48 additional pin
50 clearance plane
52 tooth of the escape wheel
54 inclined plane

The invention claimed is:

1. A sprung balance type mechanical timekeeper including:

a spiral spring (10), a balance (20), an escapement mechanism (30) connected to the spiral spring (10) and arranged to sustain an oscillation of the balance (20), wherein the escapement mechanism (30) is connected to the spiral spring (10) by a chassis (40) pivoted about an axis (A) of the balance (20), an outer end (12) of the spiral spring (10) being attached to this chassis (40) at a location on one side of the axis (A), and an escape wheel (32), wherein the escapement mechanism (30) includes a detent-type escape lever (36, 37, 38, 39) that is located on another side of the axis (A) of the balance (20) and acts on the chassis (40) so as to make the chassis (40) rotate and thus make the outer end (12) of the spiral spring (10) rotate, wherein the balance (20) is mounted on, and coaxial with, a fixed ring gear (22), and the chassis (40) carries, at said another side of the axis (A), a planet wheel (42) which is engaged with said ring gear (22) and which is driven in a stepped manner by the escapement mechanism (30), wherein the escape wheel (32) is coaxial with and secured to the planet wheel (42), and the detent-type escape lever (36, 37, 38, 39) pivots between a rest position engaged with the escape wheel (32) and a position cleared off the escape wheel (32), and wherein the outer end (12) of the spiral spring (10) is attached to the chassis (40) by a stud (14) which extends vertically between a plane of the chassis (40) and a plane of the spiral spring (10), the plane of the spiral spring (10) being disposed between the plane of the chassis (40) and the balance (20), wherein a sum of inertia of the escape wheel (32) and inertia of the chassis (40) is selected so that a direct impulse of a tooth (52) of the escape wheel (32) on an additional pin (48) occurs when a passage speed of the balance (20) is low, that is to say when an oscillation amplitude of the balance (20) is low.

2. The timekeeper according to claim 1, wherein the chassis (40) includes several branches extending on either side of a disk (44) coaxial with the balance (20) and forming with the chassis (40) a rotary plate whose axis of rotation is coincident with an axis of oscillation of the balance (20).

3. The timekeeper according to claim 2, wherein the planet pinion (42) and the chassis (40) are arranged so as to be driven in rotation by a chassis pinion (45), said planet pinion (42) being retained in rotation by blockage of the escape wheel (32) by the escapement mechanism (30), rotation of the escape wheel (32) being performed once for each oscillation cycle of the balance (20), when the balance (20) releases the escape lever (36, 37, 38, 39), so that the rotary plate performs a rotation, whose amplitude depends on a ratio of number of teeth of different wheels of the timekeeper, the rotation of the rotary plate causing a displacement of the stud (14) to ensure or contribute in sustainment of the oscillation amplitude of the balance (20).

4. The timekeeper according to claim 3, wherein an arm of the escape lever (36, 37 38 39), pushed by the escape wheel (32), is extended so that the escape lever (36, 37, 38, 39) also acts on an impulse pin (24), the energy transmitted to the balance (20) to sustain the oscillation amplitude then being distributed between a displacement of the stud (14) and impulse of an extended arm of the escape lever (36, 37, 38, 39).

5. The timekeeper according to claim 3, wherein the chassis pinion (45) is arranged so as to perform a rotation ensuring counting of oscillations cycles performed by the balance (20).

6. The timekeeper according to claim 1, wherein the escape lever (36, 37, 38, 39) includes a short inner arm (36) provided with an engagement tooth (37) which is engaged with the escape wheel (32), and a long outer arm (38) located in a path of an impulse element (24) secured in oscillation with the balance (20), wherein the impulse element (24) is brought, during the oscillation of the balance (20), to displace the escape lever (36, 37, 38, 39) from the rest position towards the position cleared off the escape wheel (32).

7. The timekeeper according to claim 1, wherein the escape lever (36, 37, 38, 39) is pivotally mounted at an outer end of an arm (39) which extends, coplanar with the chassis (40), outwardly from an axis of the planet wheel (42) and of the escape wheel (32).

8. The timekeeper according to claim 1, wherein impulses by displacement of a point of attachment of the stud (14) to the chassis (40) take place regardless of the oscillation amplitude the balance (20).

9. The timekeeper according to claim 1, wherein the escape wheel (32) has teeth (52) and a clearance plane (50) on its teeth (52) interacting with a short arm (36) of the detent mechanism (30), said clearance plane (50) preventing a too rapid return of the escape lever (36, 37, 38, 39) after a release thereof.

10. The timekeeper according to claim 1, wherein the escape wheel (32) is provided with a clearance plane (50) such that the escape lever (36, 37, 38, 39) remains held in a passing position when the balance (20) is cleared, the clearance of the balance (20) being guaranteed by an interaction between a tooth of the escape wheel (52) and the additional pin (48).

11. The timekeeper according to claim 10, wherein during passage of the balance (20) in a direction of clearance of the escape lever (36, 37, 38, 39), the balance (20) makes the escape lever (36, 37, 38, 39) pivot through the pin (48), a beak of the tooth of the escape wheel (52) leaving a rest plane of the escape lever (36, 37, 38, 39) to lie on an inclined plane (54) of the escape lever (36, 37, 38, 39) and make the latter pivot so as to let the balance (20) pass.

12. A timepiece, selected from a wristwatch, a table pendulum or a wall pendulum, including the timekeeper according to claim 1.

* * * * *